United States Patent [19]

Bradley

[11] 4,138,106

[45] Feb. 6, 1979

[54] WEIGHT TRAINING APPARATUS

[75] Inventor: Robert F. Bradley, New Buffalo, Mich.

[73] Assignee: Micro Circuits Company, New Buffalo, Mich.

[21] Appl. No.: 824,869

[22] Filed: Aug. 15, 1977

[51] Int. Cl.[2] ..... A63B 21/02; A63B 21/24

[52] U.S. Cl. ..... 272/129; 272/132

[58] Field of Search ..... 73/379; 242/129.8, 147 R; 272/116, 125, 128, 131, 132, 134, 144, DIG. 3-DIG. 6, 73, 129; 273/186 A, 186 R, 191 R, 191 A, 191 B, DIG. 21, 186, 191

[56] References Cited

U.S. PATENT DOCUMENTS

| | | | |
|---|---|---|---|
| 3,511,500 | 5/1970 | Dunn | 272/132 |
| 3,544,105 | 12/1970 | Latta | 272/125 X |
| 3,610,617 | 10/1971 | Hepburn | 272/132 |
| 3,640,530 | 2/1972 | Henson et al. | 272/125 X |
| 3,690,654 | 9/1972 | Hepburn | 272/DIG. 5 |
| 3,861,215 | 1/1975 | Bradley | 272/134 X |
| 3,874,659 | 4/1975 | Aharoni | 272/DIG. 3 |
| 3,929,331 | 12/1975 | Beeding | 272/132 |
| 4,010,915 | 3/1977 | Strutz et al. | 242/147 R |

*Primary Examiner*—Vance Y. Hum

*Attorney, Agent, or Firm*—Marmaduke A. Hobbs

[57] ABSTRACT

A weight training apparatus, which normally includes a pair of cables and a bar interconnecting the cables. The cables are wound preferably on a reel, and a brake device controls the reel to regulate the force required to unwind the cables from the reel. A mechanism responsive to the initial pull on one of the cables sets the brake mechanism for the force desired. This force can be easily changed at any point in the training exercise by merely momentarily releasing the pull on the control cable so that the brake device will be reset at another selected force requirement for unwinding the reel. The control mechanism responsive to the initial pull of the cable may be either of a mechanical or electrical type.

10 Claims, 8 Drawing Figures

WEIGHT TRAINING APPARATUS

In the past, weight training devices have been used to provide the effect of lifting weights by substituting friction or constant speed devices to simulate the resistance of weight. However, these prior mechanisms have had one or more deficiencies which have rendered them generally unacceptable as a substitute for weight lifting in training for the exercise or sport. For example, those devices in the past which have relied on friction have not varied the force required to operate them during a set, and must be set to permit completion of the last and weakest repetition of the set, and they also do not readjust for each different exercise. Such mechanisms do have advantages, however, over the constant speed devices, in that they force the user to spend more time on that part of the exercise where the muscles are weakest while speeding up passage through parts of the motion where the user is strongest.

In the training devices which rely upon constant speed mechanisms such as a centrifugal governor, exemplified by the Henson U.S. Pat. No. 3,640,530, or the motor governed constant speed of the Perrine U.S. Pat. No. 3,465,592 or Strittmatter U.S. Pat. No. 3,387,493, weak parts of the motion are passed through substantially as rapidly as strong parts, so that the weak ranges of the muscles are not selectively made more fatigued to obtain the physiological process required for increasing the muscular strength. A substantially constant speed device, which relies upon centrifugal force for the braking action, while somewhat force responsive, i.e., slowing down during weak points with very low applied force, approaches constant speed regardless of the force in the operating range where serious weight lifting is performed, in that the braking due to centrifugal force increases as the square of the speed of the braking mechanism. It is therefore one of the primary objects of the present invention to provide an exercising apparatus in which the braking force is essentially constant during any one exercise, thus permitting repetition of the user's muscles so that the muscles will move more rapidly through the part of the total motion where they are strongest and more slowly where they are the weakest.

Another object of the invention is to provide a weight training apparatus in which the braking force is reset at the beginning of each repetition and can be readjusted to provide the maximum resistance short of interrupting the movement as the user becomes weaker during each set, thus resulting in maximum effort and development.

Still another object of the invention is to provide a body development apparatus which responds to the movements of the body muscles in essentially the same manner as conventional weight lifting, as in the use of barbells, and which permits the user to perform substantially all of the movements normally performed in weight lifting to develop body muscular structure.

Another object of the invention is to provide an apparatus simulating weight lifting, which is so constructed and designed that it instantly adjusts to an infinite number of weights or forces, including the weight of any plate combination, and which provides the equivalent of a wide range of weights covering all of those normally used in the exercise or sport.

A further object is to provide an exercising apparatus of the aforesaid type which can be transported from place to place and quickly set up for use, and thereafter readily taken down for storage, and which will automatically adjust to persons of different ages and sizes and of various degrees of physical development.

Another object is to provide a sturdy and efficient apparatus of simple and economical design, construction and operation for use in achieving and maintaining physical fitness, which is safe for the inexperienced as well as the experienced person in weight lifting, which is quiet to use, handle and move, and which is suitable for use in maintaining skill and fitness for professional and amateur weight lifters and for physical training classes and instructions.

Additional objects and advantages of the invention will become apparent from the following description and accompanying drawings, wherein.

Figure 1:
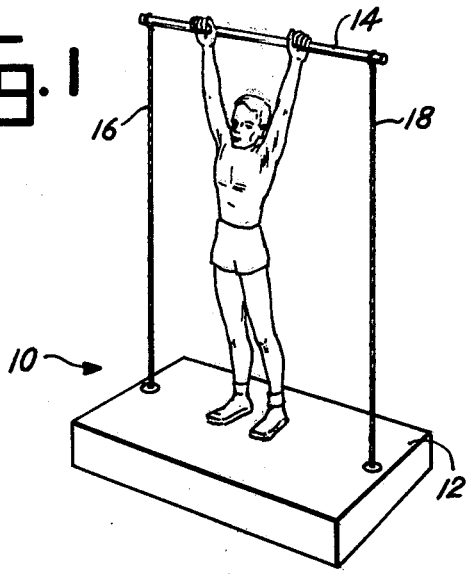
FIG. 1 is a perspective view of the present weight training apparatus, showing the manner in which it may be used.
Figure 2:
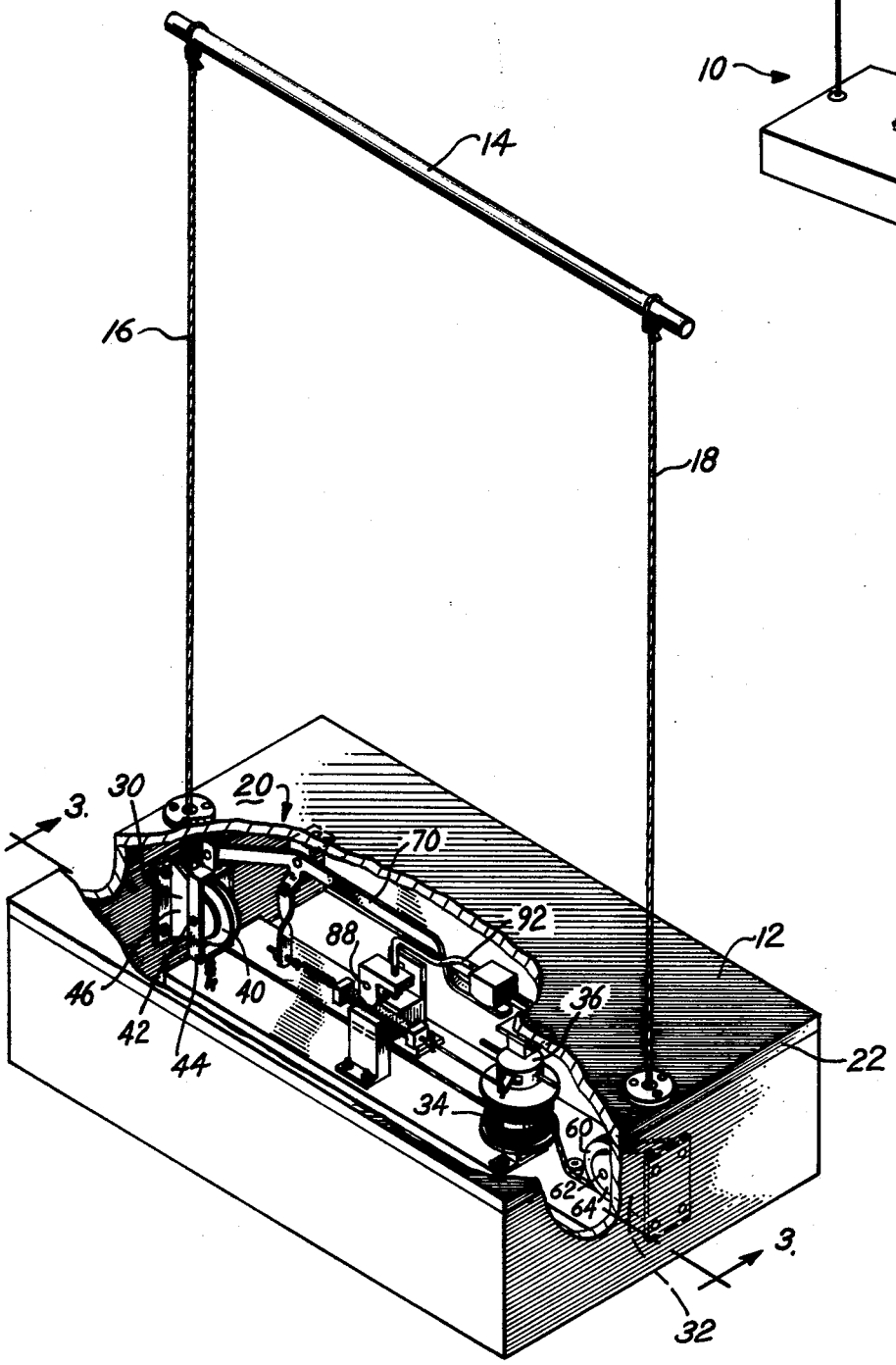
FIG. 2 is an enlarged perspective view of the present weight training apparatus, with a portion of the housing broken away to show a portion of the operating apparatus.

Referring more specifically to the drawings, and to FIGS. 1 and 2 in particular, numeral 10 indicates generally the present weight training apparatus, having a housing 12, lifting bar 14, and cables 16 and 18 connecting opposite ends of the bar to the control mechanism, indicated generally by numeral 20, disposed in the housing. The user lifts the exerciser bar 14 while standing or lying on panel 22 of housing 12; however, the housing and the internal mechanism may be used in other positions, such as on a wall for exercises where horizontal movement of the bar is appropriate.

Cable 16 passes through an opening in panel 22 and around pulley assembly 30, and cable 18 passes through an opening in panel 22 and around a pulley assembly 32, the two cables being wound on a reel 34 which rotates as bar 14 is lifted. A brake mechanism, indicated generally by numeral 36, controls the rotation of the reel and hence controls the force required to lift bar 14. A pulley 40 is journaled on a pin 42 supported by a bracket 44, and the pin, bracket and pulley are either supported or stabilized by fixture 46 which is rigidly mounted on the inside surface of one of the walls of housing 12. Pin 42 moves upwardly and downwardly in slots 48 and 50 in plates 52 and 54, respectively, of fixture 46, and the pin and bracket are urged downwardly by a coil spring 56 connected to the lower side of bracket 44 and to a structural member 58 of the housing. When the cable 16 is moved upwardly as bar 14 is lifted, the force initially moves pulley 40 and bracket 44 upwardly to provide a control force for brake 36, as will be more fully explained hereinafter. The reel is provided with a rewind spring (not shown) to rewind cables 16 and 18 when the lifting force applied to bar 14 is released.

Pulley assembly 32 includes a pulley 60 around which cable 18 is trained in changing the direction from vertical to horizontal relationship before being wound on reel 34. The pulley is journaled, on a pin 62 supported by fixture 64, the fixture being rigidly mounted on the inside surface of one of the walls of housing 12. Cable 18 passes through an opening in panel 22 around pulley 60 and roller 66 to the drum of the reel and is wound on the drum in the side opposite cable 16 so that the two cables wind and unwind together.

Figure 3:
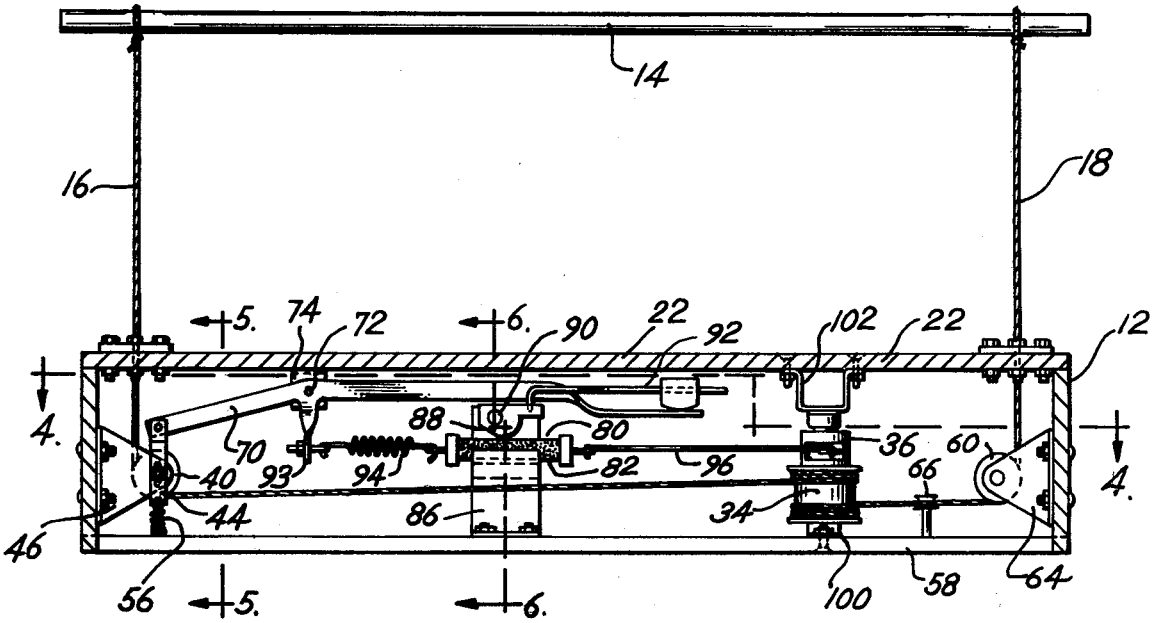
FIG. 3 is a vertical cross sectional view of the lifting apparatus shown in the preceding figures, the section being taken on line 3 —3 of FIG. 2.

The force required to lift the bar is controlled by the mechanism consisting of a bar 70 pivoted on a pin 72 mounted on bracket 74, which in turn is secured to the underside of panel 22. A brake setting device indicated generally by numeral 80 includes a friction member 82 for seating in a V-shaped groove 84 in support 86, member 82 being firmly seated in groove 84 by a cam element 88 pivotally mounted on a pin 90 and operated by a lever 92. The lever 92 is controlled by the right hand end of bar 70, as viewed in FIGS. 2 and 3. When bar 14 is at rest, spring 56 pivots the right hand end of bar 70 upwardly to a position where it lifts lever 92, which in turn lifts cam element 88 upwardly from member 82 so that member 82 can move freely along groove 84. The brake 36 is thus in its off position, permitting reel 34 to rotate freely as bar 14 and the two cables connected thereto are raised, provided the movement of the bar is sufficiently slow to prevent the control bar 70 from moving in an angular clockwise direction. When bar 14 is initially raised at a rapid rate, the force is transmitted to pulley 40, which force, in turn, is transmitted to bracket 44, causing the pulley to rise in opposition to spring 56, thereby moving the left hand end of bar 70 upwardly and rotating arm 93 in a clockwise direction. As it moves in a clockwise direction, it pulls spring 94, member 82 and rod 96 to the left, as viewed in FIGS. 2 and 3, thereby engaging brake 36. The clockwise movement of bar 70 around pin 72 permits the right hand end of the bar to lower, thereby permitting lever 92 to move downwardly and cause cam element 88 to seat member 82 firmly in slot 84, which holds brake 36 in a reel restraining position.

Figure 4:
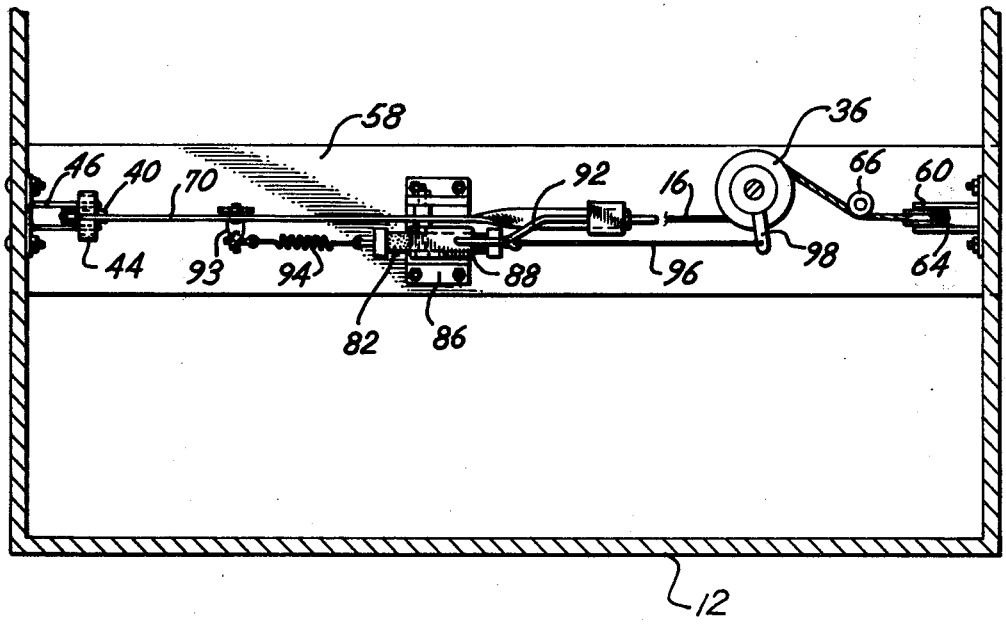
FIG. 4 is a horizontal cross sectional view taken on line 4 —4 of FIG. 3.
Figure 5:
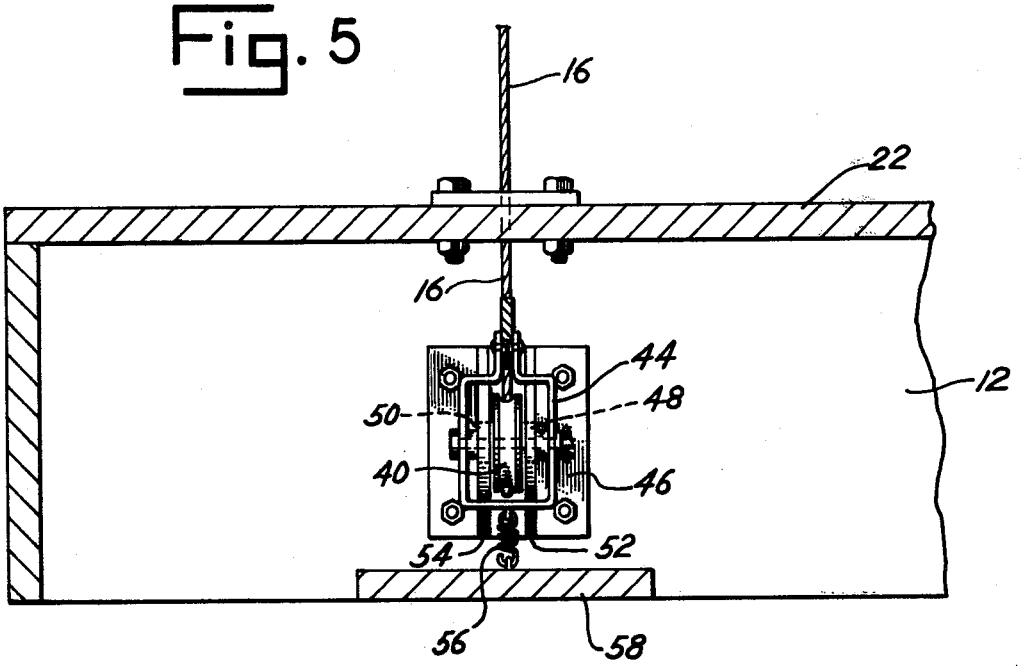
FIG. 5 is a vertical cross sectional view of the mechanism and a portion of the housing of the apparatus, the section being taken on line 5 —5 of FIG. 3.
Figure 6:
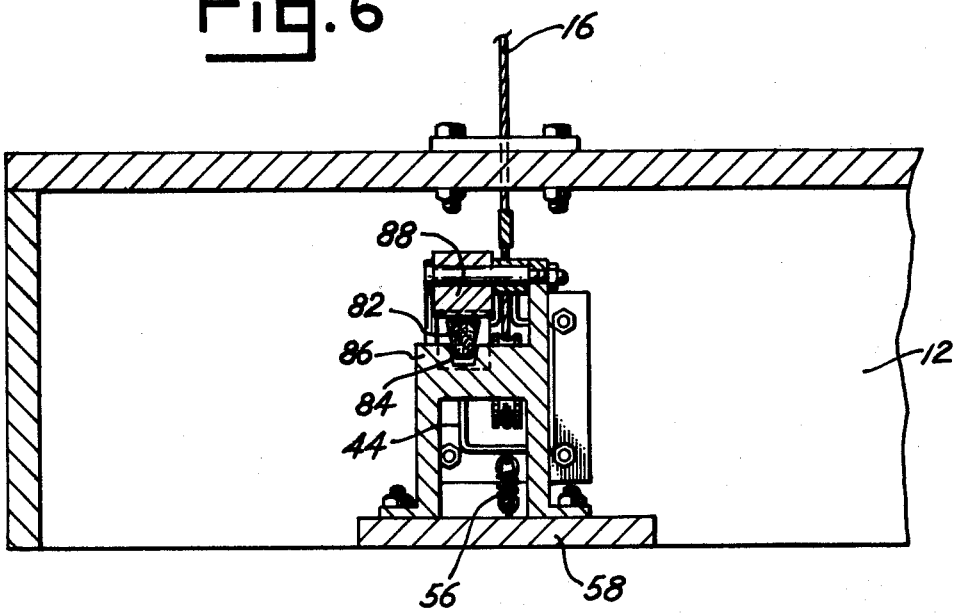
FIG. 6 is another vertical cross sectional view through the mechanism of the apparatus, the section being taken on line 6 —6 of FIG. 3.

The degree of braking by brake 36 is determined to a substantial degree by the rapidity with which bar 14 and cable 16 are initially accelerated. A sudden upward movement of bar 14 causes pulley 40 to rise rapidly, moving rod 96 swiftly leftwardly to create a strong braking action in brake 36. The lowering of the right hand end of bar 70 permits the braking force to be retained by locking number 82 in groove 84, as lever 92 actuates cam 88. The two cables 16 and 18 are wound on reel 34, so that both of the two cables operate to rotate the reel in the same direction in opposition to the force applied by brake 36. Brake 36 may be of any one of a number of well known types of brakes, having a rotatable drum or disc and a friction member for engaging the drum or disc to place a restraining force on the drum or disc as arm 98 is moved in a clockwise direction, as viewed in FIG. 4, by rod 96. The reel and brake are rigidly supported on structural member 58 and panel 22 by brackets 100 and 102, respectively, and hence are held in a stationary position beneath panel 22.

In the operation of the foregoing weight training apparatus, the one using the apparatus in the position shown in the drawings, for example, lifts bar 14, thus pulling cables 16 and 18 upwardly. A rapid movement of the bar and cable 16 upwardly causes bracket 44 to move bar 70 in a clockwise direction, which in turn moves arm 93 rapidly to the left as viewed in FIGS. 2 and 3, causing brake 36 to place an effective restraining force on the rotation of reel 34. This movement also permits lever 92 to move downwardly to cause cam 88 to urge member 82 firmly into longitudinal groove 84, thus holding the brake in a set position while the operator lifts bar 14 against the force of the braking action on reel 34. If at any stage of operation a change in the restraining effect of the brake, and hence a change in the force, are desirable, a momentary downward movement of the bar and cable 16 permits spring 56 to urge bracket 44 downwardly, thus causing bar 70 to raise lever 92. This permits cam 88 to release member 82 so that the brake will return, at least momentarily an partially, to its released position. Further continued movement upwardly, either by slow or rapid acceleration, will place the desired braking action on brake 36 in the manner described hereinbefore. It is thus seen that the degree of resistance to the lifting of rod 14 can be effectively achieved throughout a wide range of forces by merely controlling the initial movement, either slow or rapid acceleration, of the bar and cable 16 upwardly. This permits the one using the apparatus to select, at any stage or position in the lifting movement, the force which is most effective for the development of muscles at any particular stage. To release the brake, it is only necessary to lower bar 14 slightly to reverse the events detailed above. This can be done at any position of the bar. Thus a dead lift done with an initial 300 lb. brake setting can be continued after an instant re-setting at waist height to 150 lb. curl and then, with another re-setting at shoulder height, with a 200 lb. overhead press.

Figure 7:
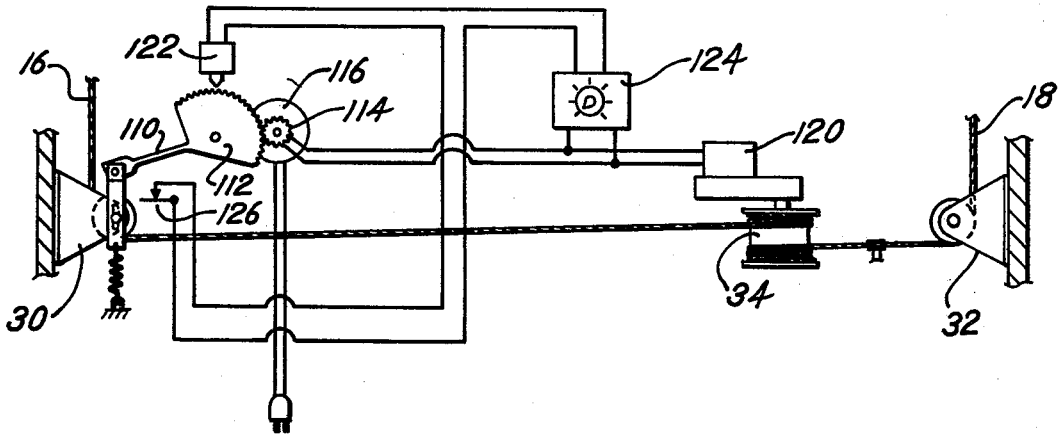
FIG. 7 is an elevational view of an electrical embodiment of the present invention.
Figure 8:
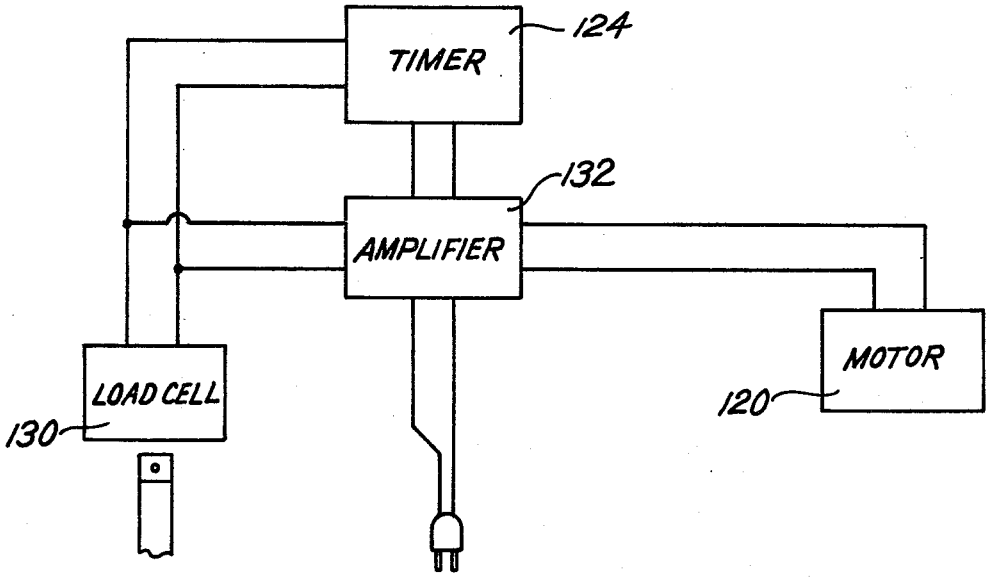
FIG. 8 is a schematic diagram of the embodiment of the invention illustrated in FIG. 7.

In FIGS. 7 and 8, a modified form of the invention is illustrated. Since a number of the parts are the same as in the embodiment previously described herein, the same numerals will be used for the same parts. These figures illustrate a simple braking and feedback system in which electricity replaces most of the feedback functions accomplished mechanically in the embodiment illustrated in FIGS. 1 through 6. The same pulley assembly 30, including bracket 44, is utilized as a control force transmitting linkage. Bracket 44 is connected to an arm 110 which rotates a segment of a fine tooth gear 112, which in turn rotates gear 114 of voltage control component 116. As exercising bar 14 is raised with a given force, the voltage control component applies a suitable voltage to the drum to rewind motor 120 to provide a resistance of restraining effect on reel 34. A separate voltage controller 122 locks the voltage control at a level determined by the force applied to bar 14, and the time delay of timer 124 interrupts the negative feedback between the force applied to the bar 14 and the resisting force applied by motor 120. A switch 126 actuated by arm 110 deactuates brake 122 to release gear 112 and permit the voltage to the motor to return to near zero when bar 14 is lowered. However, motor 120 exerts a small torque at all times to initiate the feedback cycle and to rewind reel 34. As seen in FIG. 8, a load cell 130 and amplifier 132 would normally be used in a system of this type. This type of system is different from the prior art devices in that none of the prior art devices utilize a feedback system or interruption of a feedback cycle. In the present device no reverse is required, in that control is obtained indirectly through the negative feedback in time delay mechanisms.

A scale or other type of force-measuring device is preferably included in the apparatus so that the user can determine the amount of force being required to lift bar 14. The device can be connected to and operated either by rod 96 or spring 56, and can be mounted on panel 22 of housing 12.

While two embodiments of the present weight training apparatus have been described in detail herein, various changes and modifications may be made without departing from the scope of the invention.

I claim:

1. A weight training apparatus comprising a cable for pulling in a training exercise, a reel on which said cable is wound and unwound, a brake device connected to said reel for controlling the force required to unwind said cable, and a means responsive to the initial pull of said cable for setting said brake device at a selected unwinding force for said cable including a moveable brake setting means and a moveable element on which said cable is trained shiftable in response to the initial movement of said cable, and a linkage means interconnecting said element and said brake setting means.

2. A weight training apparatus as defined in claim 1 in which a second cable spaced from said first mentioned cable is wound and unwound simultaneously on said reel, and a bar interconnects said two cables.

3. A weight training apparatus as defined in claim 2 in which said moveable element is a pulley and said means responsive to the initial pull of said cable further includes a bracket supporting said pulley, a resilient means urges the pulley in the direction opposite the force applied to said cable, and said linkge means includes a lever connected to said bracket, a control arm for said brake setting means, and means on said lever for controlling the operation of the brake setting means in response to the movement of said pulley.

4. A weight training apparatus as defined in claim 3 in which said brake setting means includes a means defining a groove, a longitudinally moveable friction member disposed in said groove, a cam for urging said friction member into said groove, and an arm operatively interconnecting with said lever for applying and releasing said friction member in response to pull on and release of said cable, respectively.

5. A weight training apparatus as defined in claim 4 in which a housing encloses said reel and means responsive to the initial pull of the cable, and has a panel for supporting the one using the apparatus.

6. A weight training apparatus as defined in claim 1 in which said moveable element is a pulley and said means responsive to the initial pull of said cable further includes a bracket supporting said pulley, a resilient means urges the pulley in the direction opposite the force applied to said cable, and said linkage means includes a lever connected to said bracket, a control arm for said brake setting means, and means on said lever for controlling the operation of the brake setting means in response to the movement of said pulley.

7. A weight training apparatus as defined in claim 6 in which said brake setting means includes a means defining a groove, a longitudinally moveable friction member disposed in said groove, a cam for urging said friction member into said groove, and an arm operatively interconnecting with said lever for applying and releasing said friction member in response to pull on and release of the cable, respectively.

8. A weight training apparatus as defined in claim 1 in which said braking device is electrically operated, a source of electrical energy for said braking device and a voltage regulating means controls the force applied by said braking device to said reel, and in which a linkage interconnects said element and said voltage regulating device to control said braking device in accordance with the movement of said element.

9. A weight training apparatus as defined in claim 8 in which a circuitry is provided for controlling the operation of said voltage regulating means.

10. A weight training apparatus as defined in claim 9 in which a second spaced cable is wound and unwound simultaneously on said reel and a bar interconnects said two cables.

* * * * *